US005903950A

United States Patent [19]

Lavin

[11] Patent Number: 5,903,950

[45] Date of Patent: May 18, 1999

[54] BRUSHING OF SURFACES

[76] Inventor: Ralph Lavin, 20 A Lakeside Dr., Atkinson, N.H. 03811

[21] Appl. No.: 08/832,423

[22] Filed: Apr. 2, 1997

[51] Int. Cl.[6] ..... A47L 11/282; A47L 11/24; A46B 7/00; A46B 9/10

[52] U.S. Cl. ..... 15/172; 15/202; 15/146; 15/160; 15/176.5

[58] Field of Search ..... 15/201, 202, 194, 15/160, 183, 186, 190, 180, 146, 236.01, 236.08, 244.1, 184, 215, 217, 176.6, 176.4, 176.1, 176.2, 172, 176.5

[56] References Cited

U.S. PATENT DOCUMENTS

| | | | |
|---|---|---|---|
| 819,960 | 5/1906 | Uhlmann | 15/202 |
| 1,017,081 | 2/1912 | Collins | 15/236.08 |
| 1,391,018 | 9/1921 | Sohnle | 15/146 |
| 1,625,537 | 4/1927 | Gullickson | 15/176.1 |
| 2,208,013 | 7/1940 | Baker | 15/176.3 |
| 2,212,513 | 8/1940 | Deitrich et al. | 15/244.1 |
| 2,514,571 | 7/1950 | Fry | 15/146 |
| 2,712,145 | 7/1955 | Karnes | 15/146 |
| 2,736,051 | 2/1956 | Boodakian | 15/166 |
| 3,188,675 | 6/1965 | Beek | 15/244.1 |
| 4,399,581 | 8/1983 | Tuzzolino | 15/176.3 |
| 4,403,623 | 9/1983 | Mark | 15/172 |
| 5,319,824 | 6/1994 | Cook, III | 15/172 |
| 5,324,129 | 6/1994 | Root | 15/172 |
| 5,412,829 | 5/1995 | Hefner | 15/172 |

FOREIGN PATENT DOCUMENTS

| | | | |
|---|---|---|---|
| 97019 | 4/1898 | Germany | 15/146 |
| 5143 | 9/1911 | United Kingdom | 15/190 |

*Primary Examiner*—Gary K. Graham
*Attorney, Agent, or Firm*—George E. Kersey, Esq.

[57] ABSTRACT

Apparatus for facilitating the brushing of surfaces wherein an elongated support member has a longitudinally-extending channel in one surface and a aperture therethrough; a transverse channel intersects the longitudinally-extending channel and extends across the apertures; and a brush is positioned in one of the transverse channels, or in the longitudinally-extending channel.

16 Claims, 6 Drawing Sheets

Fig. 2A
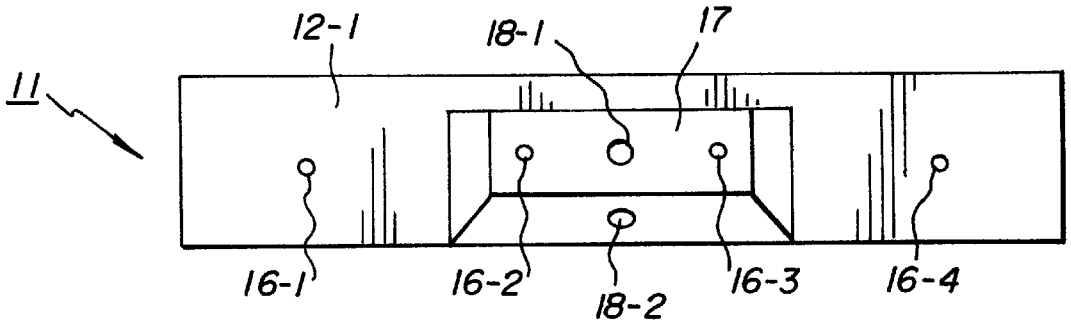
Fig. 2B
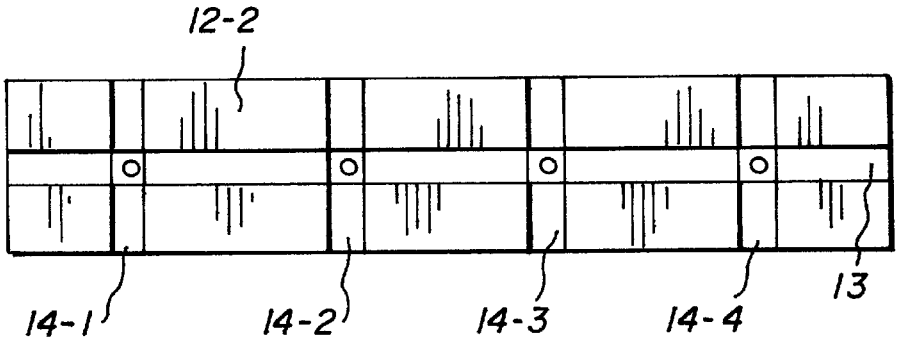
Fig. 3A
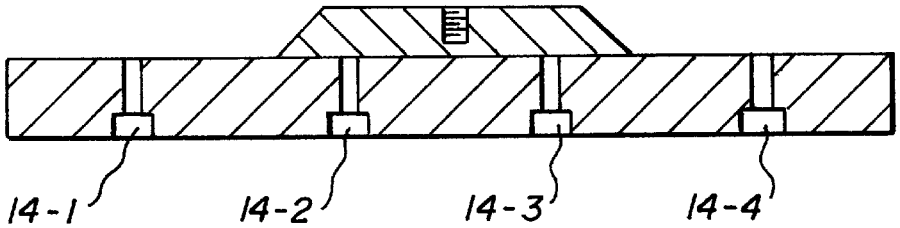
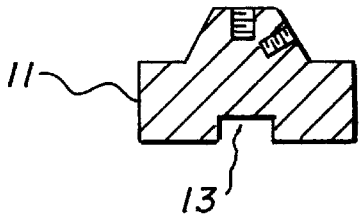
Fig. 3B

BRUSHING OF SURFACES

BACKGROUND OF THE INVENTION

This invention relates to the brushing of surfaces and more particularly, to the wide area brushing and painting surfaces.

The brushing and painting of surfaces conventionally takes place using a device, known as a "brush" in which a handle extends from one side of a hard block and bristles, hairs or wires are fastened to the opposite side of the block, and are held in place by a metallic or plastic band that encircles the block.

Brushes are used for painting, smoothing, cleaning and polishing. The bristles or wires of the brush may be attached in a fan-like spread or as a compact collection.

The typical brush is suitable primarily for relatively flat surfaces. If irregular surfaces are involved, the width of the brush must be narrowed accordingly.

Because of the limited width of ordinary brushes, attempts have been made to cover relatively wide surfaces using sprayers and other applicators. Such sprayers and applicators often leave an irregular coating. In many cases it is either necessary or desirable to finish the coated surface by brushing in order to achieve desired uniformity and relative smoothness. Unfortunately, the need for subsequent brushing in the case of spraying and other paint applications partially defeats the labor-saving advantage of spraying or using other applicators in the first place.

Accordingly, it is an object of the invention to facilitate the brushing of surfaces. A related object is to facilitate the supplemental brushing of surfaces that have been sprayed or coated using other forms of applicators.

Where a brush alone is to be used to apply a coating, for example, of paint, it is desirable for the brush to be as wide as possible. Unfortunately, extending the width of the conventional brush result in a relatively unwieldy device.

A further object of the invention is to achieve an increase in effective brush width without the disadvantages associated with brushed of increased width.

Another object of the invention is to achieve wide area coverage of irregular surfaces as well as wide area coverage of regular surfaces with reduced cost and complexity.

SUMMARY OF THE INVENTION

In accomplishing the foregoing and related objects the invention provides for facilitating the brushing of surfaces by an elongated support member having a longitudinally-extending channel in one surface, and a plurality of transverse channels intersecting the longitudinally-extending channel.

The channels are provided to receive one or more brushes, each having a base positioned in either the longitudinal channel or one of the transverse channels.

A handle can be attached to the support member opposite the surface containing the longitudinal channel and the transverse channels. The handle is inserted into a threaded opening of said member positioned in the support member with an axis aligned with the longitudinally-extending channel.

Alternatively, the threaded opening can be positioned in the support member with an axis extending transversely with respect to the longitudinally-extending groove.

A refill brush of the invention for the longitudinally-extending support member includes a base having opposite sides; a set of bristles attached at one side of the base; and a connector extending from the opposite side of the base for attachment of the refill brush to the support member. The connector for attaching the refill brush to the support member can be a threaded insert into the base of the brush and extending outwardly for engagement with the support member.

In a method of brushing a surface in accordance with the invention, the steps include (a) positioning a brush in a channel of an elongated support member; and (b) using the support member with the brush positioned therein to engage the surface.

The method can further include the step of positioning a plurality of brushes in one or more of the channels.

The brushes positioned in a channel of the support member can have the same or different orientation relative to one another.

The brushes can be positioned in the channel to be aligned therealong to enhance the brushing capacity of said support member. The brushes also can be positioned alternately transverse to one another so that the support member can be used for the brushing of planar surfaces having elongated grooves therein.

The method further includes the step of inserting a handle in the support member at an acute angle in relation to the longitudinal extension of the member, or the lateral width of the member.

In a method of the invention for manufacturing apparatus to facilitate the brushing of surfaces the steps include (a) providing an elongated support member having opposed surfaces; (b) creating in one surface of the support member at least one longitudinal channel and at least one transverse channel; (c) positioning a mount on the opposite one of the surfaces; and (d) providing a plurality of attachment apertures in the mount.

The method further includes attaching at least one brush to the support member in one of the channels thereof. A through-opening extends from at least one of the channels, and the brush is formed by a base having a threaded shaft extending therefrom and brush fibers extending from the base opposite the threaded shaft. The threaded shaft is inserted into the through-opening and affixed to the mount by a connector.

DESCRIPTION OF THE DRAWINGS

Other aspects of the invention will become apparent after considering several illustrative embodiments taken in conjunction with the drawings in which:

FIG. 2A is a bottom view of the brush holder of FIGS. 1A and 1B.

FIG. 2B is a top view of the brush holder of FIGS. 1A and 1B.

FIG. 3A is a side-sectional view of the brush holder of FIGS. 1A and 1B.

FIG. 3B is an end-sectional view of the brush holder of FIGS. 1A and 1B.

DETAILED DESCRIPTION

Figure 1A:
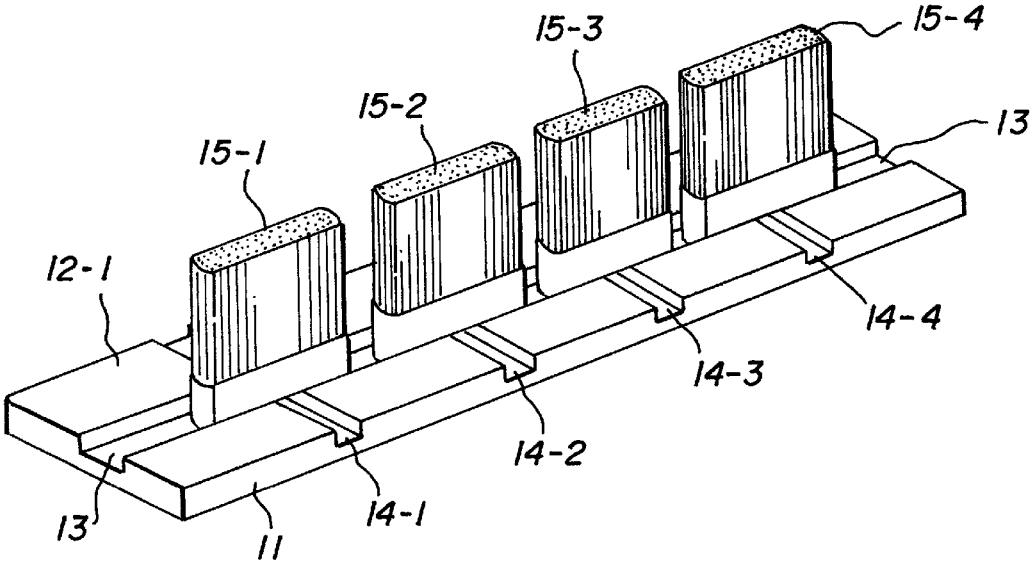
FIG. 1A is a perspective view showing the brushing assemblage of the invention with included brushes adopting one configuration.

With reference to the drawings, FIG. 1A shows the brushing assemblage 10 of the invention formed by an elongated support member or brush holder 11 which has opposing surfaces 12-1 and 12-2. One of the surfaces 12-1 has a longitudinally-extending channel 13 and a plurality of transverse channels 14-1 through 14-4 that intersect the longitudinally-extending channel 13. Positioned in the longitudinal channel 13 are brushes 15-1 through 15-4, each fabricated in accordance with the invention as described in detail below, so that each brush can be secured to the support member or holder 11 opposite the surface 12-1.

In effect, the arrangement of FIG. 1A, with individual brushes 15-1 through 15-4 having an illustrative width of 4 inches, achieves the equivalent of a 16-inch paint brush.

Because of the flexibility provided by the invention, the same tool can be converted into a 12 inch paint brush, by removing one of the brushes, and further into an 8 inch paint brush by removing two of the brushes, depending upon the nature of the surface that is to be brushed.

In the arrangement of FIG. 1A, the four brushes 15-1 through 15-4 are longitudinally aligned, so that operation of the support member 11 against a surface to be brushed provides substantially four times the stroking coverage that is achieved by a single brush alone.

Figure 1B:
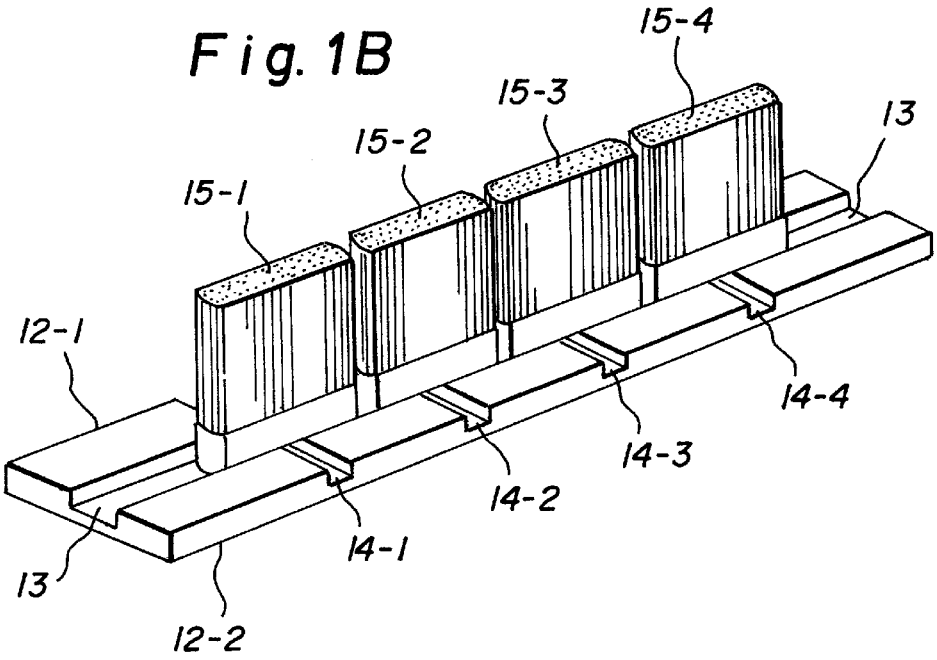
FIG. 1B is a perspective view showing the brushing assemblage of the invention with the included brushes adopting another configuration.

If a closer alignment is desired the brushes 15-1 through 15-4 can be more closely positioned relative to one another as shown in FIG. 1B, in which case a suitable adjustment is made, so that each brush can be secured to the support member or holder 11 opposite the surface 12-1.

Figure 1C:
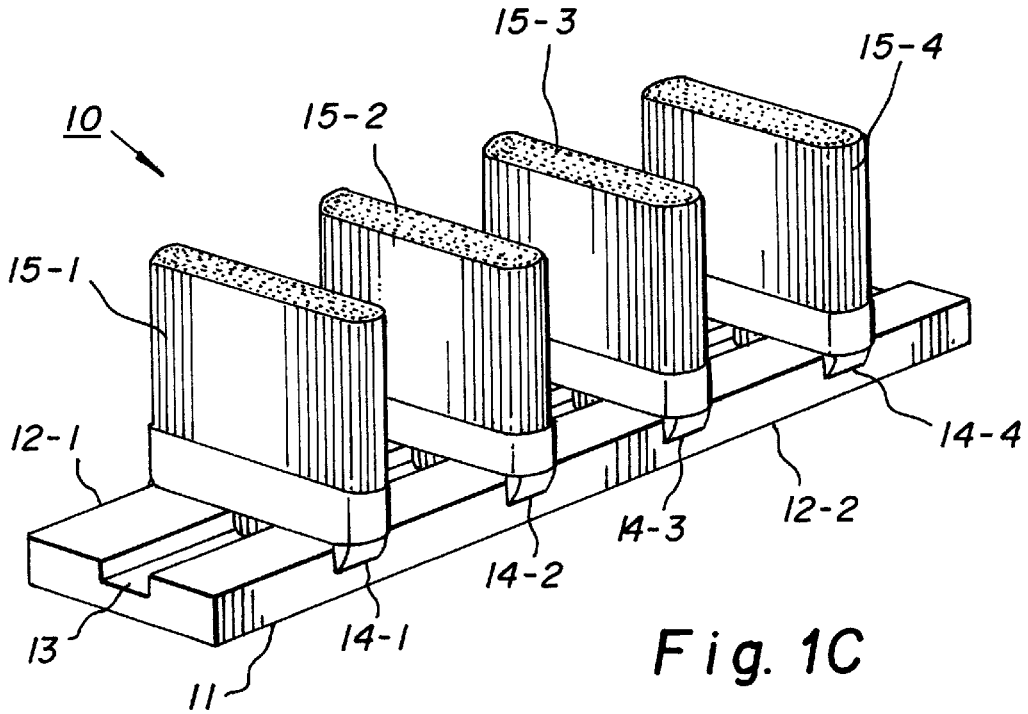
FIG. 1C is a perspective view showing the brushing assemblage of the invention with included brushes adopting a further configuration.

Since not all surfaces to be brushed are planar, the invention permits the brushes 15-1 through 15-4 of FIG. 1A to be re-oriented, for example, as shown in FIG. 1C where the brushes 15-1 through 15-4 are transverse to the longitudinal channel 13 and respectively occupy the transverse channels 14-1 through 14-4.

Figure 1D:
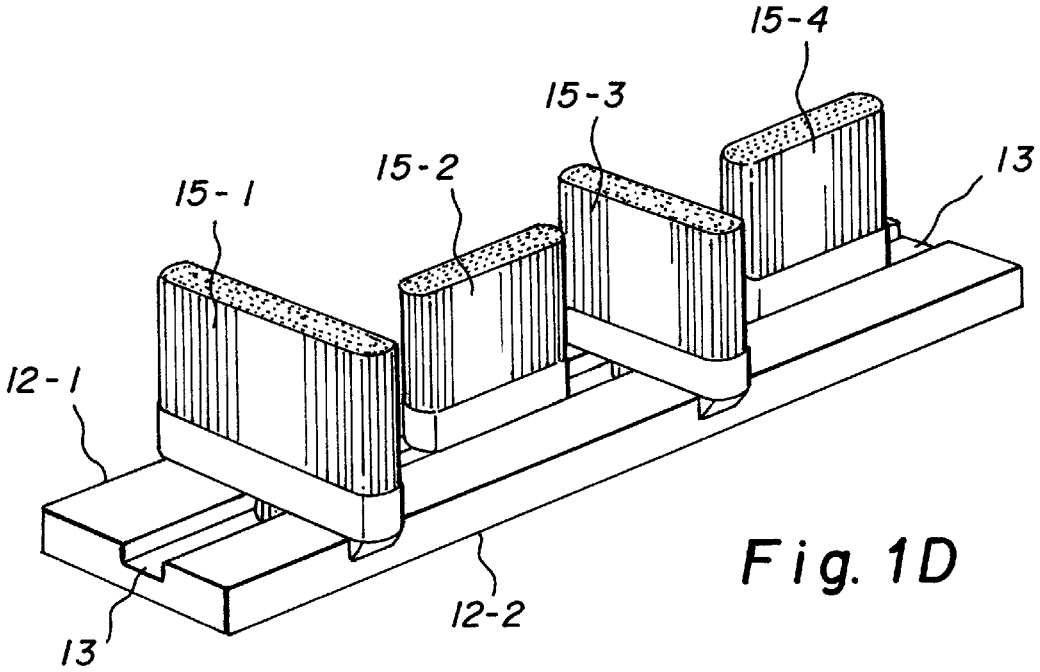
FIG. 1D is a perspective view showing the brushing assemblage of the invention with the included brushes adopting still another configuration.

In another re-orientation shown in FIG. 1D the brushes 15-1 and 15-3 are transverse in relation to the brushes 15-2 and 15-4. In the particular configurations of FIGS. 1C and 1D, the brushes are adaptable to the painting of barn board known as "T-111" in which vertical panels are separated from one another by groves which can be brushed and painted by the transverse brushes 15-1 and 15-3, while the longitudinal brushes 15-2 and 15-4 either brush or apply paint to the main T-111 barn board arrangement.

Details of the support member or brush holder 11 are illustrated in FIGS. 2A through 3B. In FIG. 2A, which is a bottom view of the support member 11, channels 14-1 through 14-4 are shown on the bottom surface 12-1 of the member 11. Also indicated in FIG. 2A are openings 16-1 through 16-4 that extend through the member 11 to the opposite surface 12-2 as indicated in FIG. 2B. The openings 16-1 through 16-4 permit the brushes 15-1 through 15-4 to be attached to the member 11 because of the brush structure illustrated below in connection with FIGS. 3A and 3B.

Figure 5A:
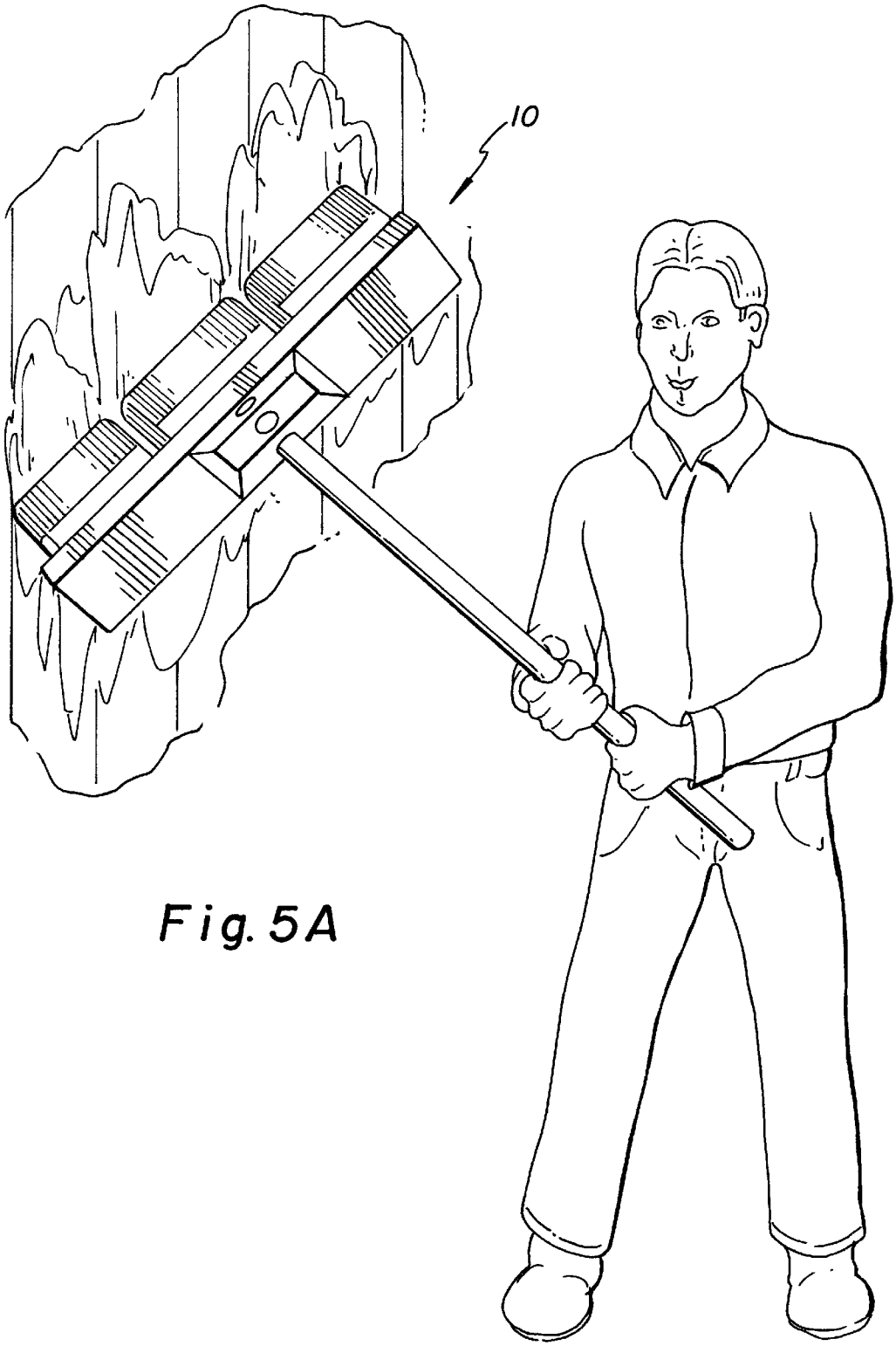
FIG. 5A illustrates the use of the brush holder and brushes of FIGS. 1A and 1B for the brushing of surfaces at an elevated height.
Figure 5B:
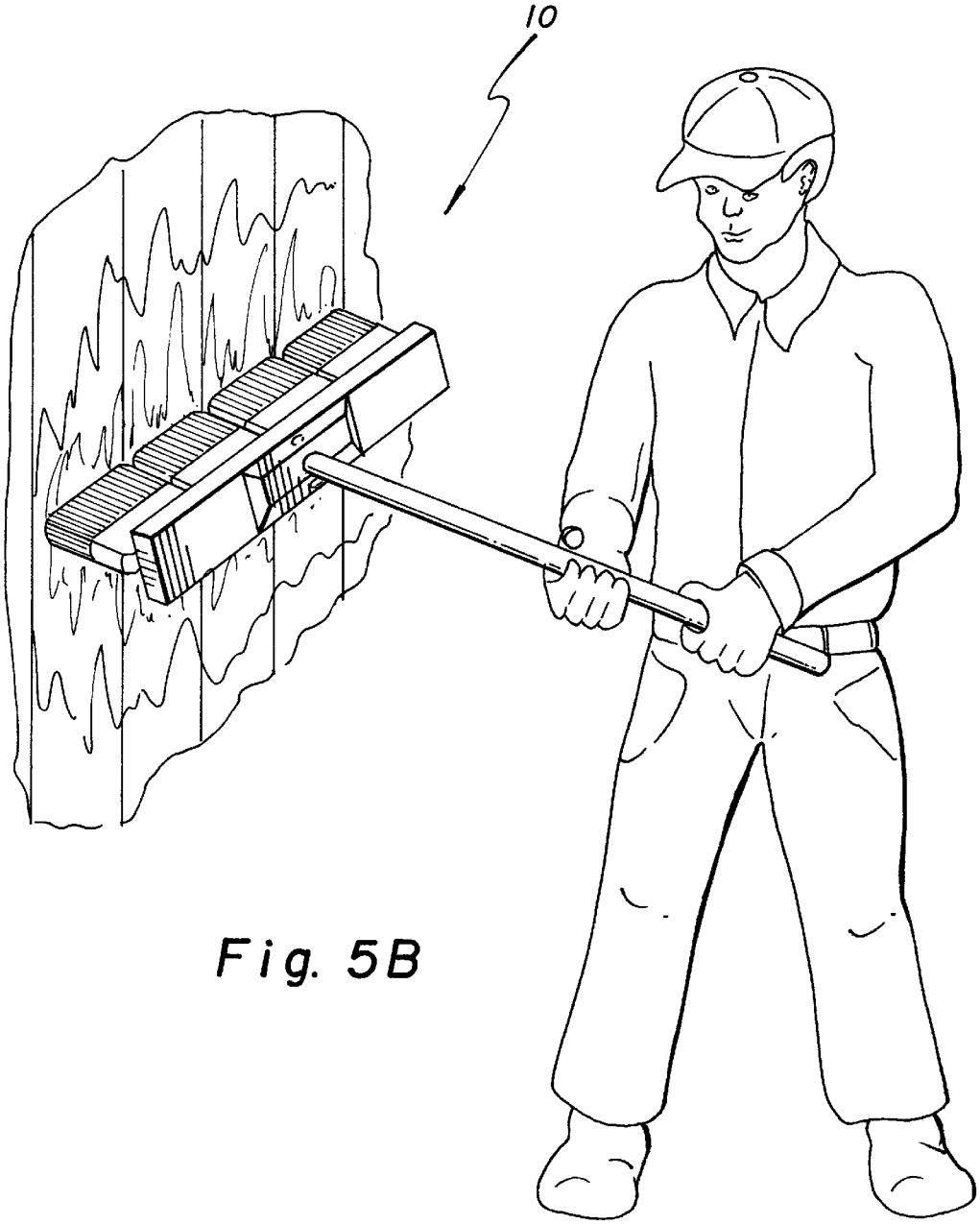
FIG. 5B illustrates the use of the brush holder and brushes of FIGS. 1A and 1B for the wide-area brushing of surfaces in accordance with the invention.

Also shown in FIG. 2B is a mount 17 of the brush holder 11 that includes threaded openings 18-1 and 18-2 for the attachment of a handle 19 as shown in FIGS. 5A and 5B. A threaded opening 18-1 is off-set in the top surface of the mount 17 and extends at an angle of about 30 degrees in relation to the longitudinal dimension of the member 11 to permit the attachment of the operating handle shown in FIG. 5A by which the brushing assemblage 10 of the invention facilitates the brushing of relatively elevated surfaces.

The threaded opening 18-2 in the mount 17 of the brush holder 11 permits the handle 19 to be attached to the mount 17 as shown in FIG. 5B. The threaded opening 18-2 extends at an angle of about 45 degrees in relation to the transverse dimension of the member 11. This permit the attachment of the operating handle shown in FIG. 5B by which the brushing assemblage 10 of the invention facilitates the brushing of ordinary surfaces.

Figure 4A:
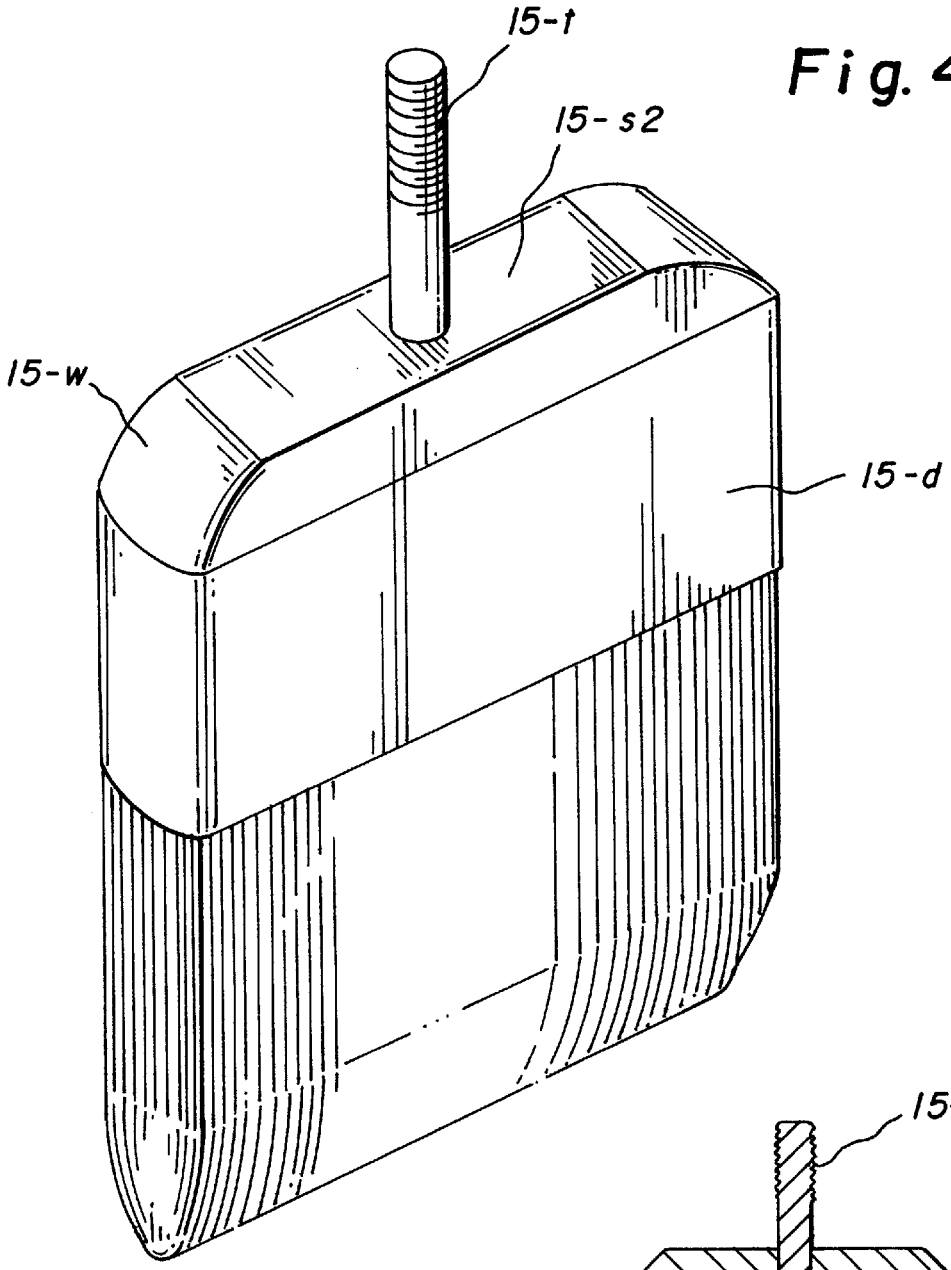
FIG. 4A is a perspective view of a brush after removal from the holder of FIGS. 1A and 1B.
Figure 4B:
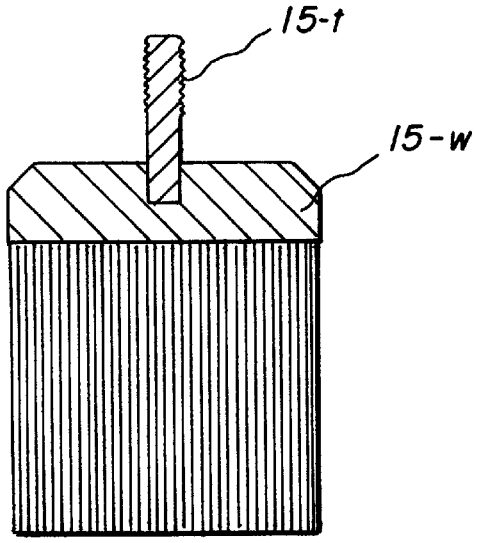
FIG. 4B is a sectional view of the brush of FIG. 4A.

The illustrative brush 15 of FIG. 4A, shown removed from the holder 11 of FIGS. 1A and 1B, has a wooden base 15-*w* with one side 15-*s*1 carrying bristles 15-*b* secured to the base 15-*w* by a band 15-*d*. The side 15-*s*2 of the brush 15 is configured to sit in the 13, one of the channels 14 of FIGS. 1A and 1B. This is achieved by sawing off the handle portion 15-*h* shown in phantom in FIG. 4A, and inserting a threaded shaft 15-*t*. The brush 15 is shown in cross section in FIG. 4B.

FIG. 5A illustrates the use of the brush holder and brushes of FIGS. 1A and 1B for the brushing of surfaces at an elevated height; and FIG. 5B illustrates the use of the brush holder and brushes of FIGS. 1A and 1B for the wide-area brushing of surfaces in accordance with the invention.

Other uses and adaptations of the invention, including adjustments and accessories with respect to the hand grips and the arcuate retainers, will be readily apparent to those of ordinary skill in the art.

What is claimed is:

1. Apparatus to facilitate brushing of surfaces comprising (a) an elongated support member having opposed surfaces;

(b) at least one longitudinal channel and one transverse channel in one of said surfaces of said support member;

(c) a mount positioned on the opposite one of said surfaces; and (d) a plurality of attachment apertures in said mount;

further including at least one brush attached to said support member in one of the channels thereof;

wherein a through-channel extends from at least one of the longitudinal and transverse channels to said opposite surface and said brush is formed by a base having a threaded shaft extending therefrom and brush fibers extend from said base opposite said threaded shaft, with said threaded shaft inserted into said through-channel and affixed to said mount by a connector thereto.

2. Apparatus as defined in claim 1 for brushing a surface comprising means for using said support member with said brush positioned therein to engage said surface for brushing.

3. Apparatus as defined in claim 1 further including a plurality of brushes positioned in one of said channels.

4. Apparatus as defined in claim 3 further including said brushes positioned in said one of said channels to have the same orientation relative to one another.

5. Apparatus as defined in claim 3 further including said brushes positioned in said one of said channels to have different orientations relative to one another.

6. Apparatus as defined in claim 3 further including said brushes positioned in said one of said channels aligned therealong;

thereby to enhance the brushing capacity of said support member.

7. Apparatus as defined in claim 3 further including said brushes positioned to be alternately vertically transverse to one another;

whereby said support member can be used for the brushing of planar surfaces having longitudinal grooves therein.

8. Apparatus of claim 3 further including a handle inserted in said support member at an acute angle in relation to the longitudinal extension of said member.

9. Apparatus of claim 3 further including a handle inserted in said support member, having a lateral width, at an acute angle in relation to said lateral width.

10. Apparatus to facilitate brushing comprising (a) an elongated support member having opposed surfaces;

(b) at least one longitudinal channel and one transverse channel in one of said surfaces of said support member;

(c) a mount positioned on the opposite one of said surfaces; and at least one brush attached to said support member in one of the channels thereof;

wherein a through-channel extends from at least one of the longitudinal and transverse channels to said opposite surface and said brush is formed by a base having a threaded shaft extending therefrom and brush fibers extend from said base opposite said threaded shaft, with said threaded shaft inserted into said through-channel and affixed to said mount by a connector thereto.

11. Apparatus for facilitating brushing of surfaces comprising an elongated support member having a longitudinally-extending channel in one surface of said member and an aperture therethrough; and a transverse channel intersecting said longitudinally-extending channel and extending across said aperture;

wherein a handle is attachable to said support member opposite said surface, inserted into a threaded opening of said member.

12. Apparatus as defined in claim 11 further including a brush having a base confined in said transverse channel.

13. Apparatus as defined in claim 11 further including a brush having a base confined in said longitudinally-extending channel.

14. Apparatus as defined in claim 11 wherein said threaded opening is positioned in said member opposite said surface with an axis extending transversely with respect to said longitudinally-extending channel.

15. Apparatus as defined in claim 11 wherein a refill brush for a longitudinally-extending support member is contained in said longitudinally extending channel, said brush comprising a base having opposite sides and proportioned to fit into said channel;

a set of bristles attached at one side of said base; and a connector extending from the opposite side of said base for attachment of said refill brush to said support member.

16. A refill brush as defined in claim 15 wherein said connector comprises a threaded insert into the base of said brush and extending outwardly for engagement with said support member.

* * * * *